US006183299B1

(12) United States Patent
Ward et al.

(10) Patent No.: US 6,183,299 B1
(45) Date of Patent: Feb. 6, 2001

(54) AUTOMOTIVE CELLULAR PHONE CONNECTOR ASSEMBLY

(75) Inventors: Bobby Gene Ward, King; Wolfgang Hoelscher, Greensboro, both of NC (US)

(73) Assignee: The Whitaker Corporation, Wilmington, DE (US)

( * ) Notice: Under 35 U.S.C. 154(b), the term of this patent shall be extended for 0 days.

(21) Appl. No.: 09/296,570

(22) Filed: Apr. 22, 1999

Related U.S. Application Data

(60) Provisional application No. 60/087,326, filed on May 29, 1998.

(51) Int. Cl.[7] ..... H01R 13/40

(52) U.S. Cl. ..... 439/595; 439/752

(58) Field of Search ..... 439/595, 540.1, 439/585, 536, 465, 467, 470, 752, 606, 548

(56) References Cited

U.S. PATENT DOCUMENTS

| | | | | |
|---|---|---|---|---|
| D. 315,543 | | 3/1991 | Soren et al. | D13/133 |
| 4,557,542 | | 12/1985 | Coller et al. | 439/595 |
| 4,806,123 | * | 2/1989 | Konishi et al. | 439/595 |
| 4,825,217 | | 4/1989 | Choi | 343/715 |
| 4,891,021 | | 1/1990 | Hayes et al. | 439/599 |
| 4,915,641 | * | 4/1990 | Miskin et al. | 439/247 |
| 4,944,688 | | 7/1990 | Lundergan | 439/275 |
| 4,979,912 | * | 12/1990 | Shindo et al. | 439/595 |
| 4,979,913 | | 12/1990 | Aiello et al. | 439/596 |
| 4,984,998 | | 1/1991 | Duncan et al. | 439/352 |
| 5,071,369 | * | 12/1991 | Denlinger et al. | 439/595 |
| 5,181,862 | | 1/1993 | Hawk et al. | 439/595 |
| 5,234,353 | * | 8/1993 | Scholz et al. | 439/289 |
| 5,239,700 | | 8/1993 | Guenther et al. | 455/158.4 |
| 5,314,357 | * | 5/1994 | Weidler | 439/701 |
| 5,622,521 | | 4/1997 | Marceau et al. | 439/595 |
| 5,724,663 | | 3/1998 | Lee | 455/557 |
| 5,941,718 | * | 8/1999 | Didier | 439/170 |
| 5,964,621 | * | 10/1999 | Wolla et al. | 439/595 |

FOREIGN PATENT DOCUMENTS

| | | | |
|---|---|---|---|
| 0 772 257 A1 | 5/1997 | (EP) | H01R/13/436 |
| 0 827 236 A1 | 3/1998 | (EP) | H01R/13/436 |
| 2 702 889 | 9/1994 | (FR) | H01R/13/629 |
| 1 262 664 | 6/1993 | (GB) | H01R/13/436 |
| 3-20880 | 2/1991 | (JP) . | |

OTHER PUBLICATIONS

European Search Report, Application No. 99 30 3913.

* cited by examiner

*Primary Examiner*—T. C. Patel

(57) ABSTRACT

An electrical connector assembly (20) is primarily intended for use in connecting portable electronic devices (22), such as cellular telephones, to the electrical system of a motor vehicle. The electrical connector assembly (20) includes a plug connector (30) that can be attached to a cord (24) for connection to the portable electronic device. A mating receptacle connector (60) is permanently mounted in the motor vehicle and is attached to an automotive wiring harness. The receptacle connector (60) includes a secondary lock or terminal position assurance member (110) that forms the front cover of the receptacle connector (60) when properly positioned. Primary terminal latches (100) securing receptacle terminals (62) in a housing (74) are exposed on the top and bottom surfaces and the secondary lock (110) surrounds these primary latches (100) when properly positioned on the connector. Terminals (62) can therefore be positioned on the relatively close centerlines characteristic of electrical connectors used with portable electronic devices.

16 Claims, 12 Drawing Sheets

AUTOMOTIVE CELLULAR PHONE CONNECTOR ASSEMBLY

CROSS REFERENCE TO RELATED APPLICATIONS

This application claims the benefit of provisional application 60/087,326 filed May 29, 1998.

BACKGROUND OF THE INVENTION

1. Field of the Invention

This invention is related to an electrical connector assembly that can be used in a motor vehicle that would permit an external electronic apparatus, such as a cellular telephone, to access the electrical system of vehicle. Furthermore this invention is related to an electrical connector assembly in which one of the electrical connectors is of the type that would be connected to an external cord extending from an external electronic component, and the other electrical connector is of the type that would be permanently attached to a vehicle wiring harness and would include secondary locking and terminal position assurance means.

2. Description of the Prior Art

Electrical connectors for use in motor vehicles and automobiles employ certain characteristics that differ form electrical connectors that are used for electronic devices such as cellular telephones. For example, electrical connectors that are employed with automotive wiring harnesses must be robust and reliable and must simplify installation. On the other hand electrical connectors that are used for portable electronic devices are generally attached to and detachable from external cords and space and size are significant constraints. For example, signal currents in automobiles are typically carried by 20–22 AWG wires and terminals are typically located on centerline spacings of 2.54–5.5 mm. On the other hand signal wires for use with portable electronic devices often employ 26 to 28 AWG wires and terminals are typically located on centerline spacings of less than 2.54 mm. The different sizes and different environments in which these electrical connectors are used therefore result in different features being employed in each. For example, secondary locks and terminal position assurance members are often used on electrical connectors used for motor vehicle applications in order to prevent wiring errors and discontinuities during the installation of wiring harnesses. Electrical connectors used for portable electronic devices often employ overmolded strain reliefs between an external cord and the electrical connector housing.

Many portable electronic devices are commonly employed by the occupants of a motor vehicle. Cellular telephones are perhaps the most common. Even though these commonly available portable electronic devices are employed by occupants of motor vehicles, they seldom employ or take advantage of the vehicle's electrical system or of components of the vehicle's electrical system, such as antennas and speakers, or of components, such as microphones that can be easily installed in a vehicle's electrical system. For example, the only use made by a conventional cellular telephone of a vehicle's electrical system is the use of the electrical power supply. An adapter is commonly used to connect the cellular telephone base to the vehicle's electrical power supply through a cigarette lighter.

A connector interface between a vehicle's electrical system and portable electronic devices of various types is desirable. However, such an interface would not be satisfactory unless it could employ the desirable aspects of electrical connections for both permanent automotive wiring installations and those used with existing and anticipated portable electronic devices. An important factor is that the benefits of secondary locking and terminal position assurance members that are employed with existing automotive connectors should be included in a connector assembly that is substantially the same size as those employed with portable electronic devices, such as cellular telephones.

SUMMARY OF THE INVENTION

An electrical connector assembly suitable for use by an occupant to connect and disconnect an electronic apparatus to an electrical system in a motor vehicle should include terminals in the permanently mounted vehicle connector that are not exposed. Such a system would include a plug connector attached to the electronic apparatus with male terminals or pins. A receptacle electrical connector, matable with the plug connector would be mounted in the motor vehicle in a position accessible by an occupant of the motor vehicle. The receptacle connector would include receptacle terminals that are only exposed through openings for receiving pins on the plug connector. This receptacle electrical connector includes primary locks securing the receptacle terminals in the receptacle connector and a secondary lock providing an additional means for securing the receptacle terminals in the receptacle connector.

An electrical connector permanently mounted in the vehicle for connecting a cellular telephone to a wiring harness in a motor vehicle would employ a housing with receptacle terminals secured in the housing by terminal latches comprising extensions of the housing. These receptacle terminals are accessible through a front surface by pin terminals in a mating electrical connector attached to the cellular telephone. A coaxial terminal in the housing connects an antenna in the motor vehicle to the cellular telephone. A terminal position assurance member is shiftable into a fully assembled position behind the terminal latches on the housing only when receptacle terminals are fully inserted into the housing.

This electrical connector assembly connects an electronic component to an apparatus, such as an antenna or microphone in the system. The first electrical connector is attached to wires extending from the electronic component including a plurality of pin terminals in at least one row. The pin terminals are positioned in multiple groups of multiple pin terminals, and separate groups of pin terminals are separated by internal walls extending perpendicular to the row of pin terminals. The second electrical connector is attached to the apparatus or motor vehicle and includes a plurality of receptacle terminals, also in at least one row, positioned in multiple groups of receptacle terminals. Adjacent groups of receptacle terminals are separated by slots extending perpendicular to the row of receptacle terminals. The slots are configured to receive the internal walls when the first and second electrical connectors are mated.

An electrical connector assembly incorporating these features is therefore suitable for use with existing portable electronic devices and can also retain advantageous features of automotive harness connectors in a connector that employs terminals positioned on the centerlines characteristic of portable electronic devices.

BRIEF DESCRIPTION OF THE DRAWINGS

FIG. 13 is an alternate embodiment showing a shrouded receptacle connector.

DETAILED DESCRIPTION OF THE PREFERRED EMBODIMENTS

Figure 1:
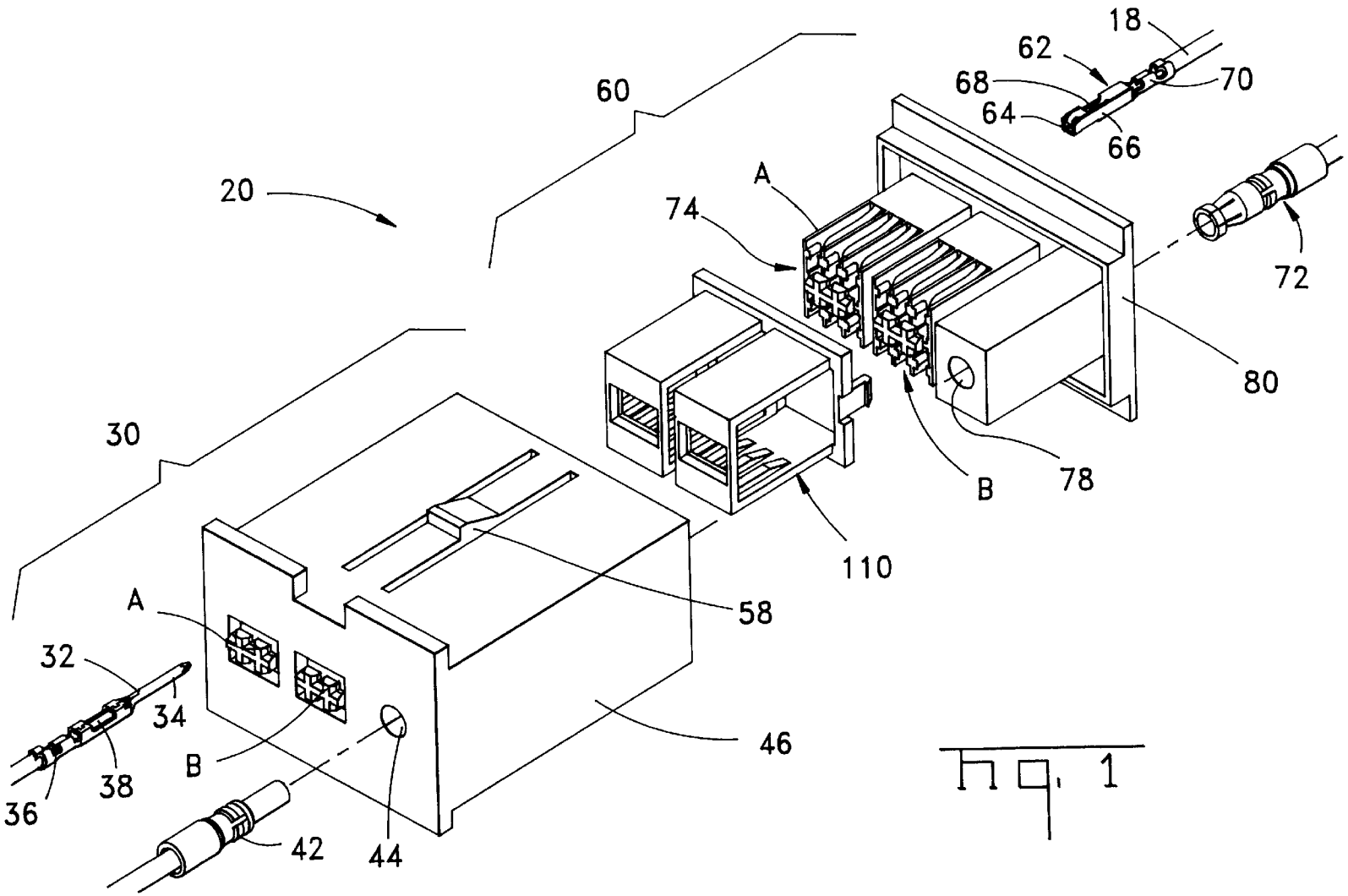
FIG. 1 is an exploded perspective view showing a vehicle mounted receptacle connector, a secondary locking member, a plug connector that can be attached to a cord, receptacle and pin terminals and male and female coax terminals.

Electrical connector assembly 20 includes a first or plug electrical connector 30 and a second or receptacle electrical connector 60. The plug connector 30 is attached to a cord 24 extending from an electronic apparatus such as a cellular telephone 22. The receptacle connector 60 is mounted on a panel or wall of a vehicle such as an automobile or another apparatus, and connector 60 includes a secondary lock or terminal position assurance member 110 forming its front cover. Receptacle connector 60 extends beyond the surrounding panel or wall so that it is exposed and easily accessible, and the plug connector 30 can be mated to it. When used in an automobile or motor vehicle, the receptacle connector 60 would be located in a position where it would be accessible by an occupant of the motor vehicle. Alternatively, the receptacle connector 60 could be located in an inaccessible location and a cable could extend to an accessible location where a conventional interface for a portable electronic device, such as a cellular telephone could be located.

Figure 2:
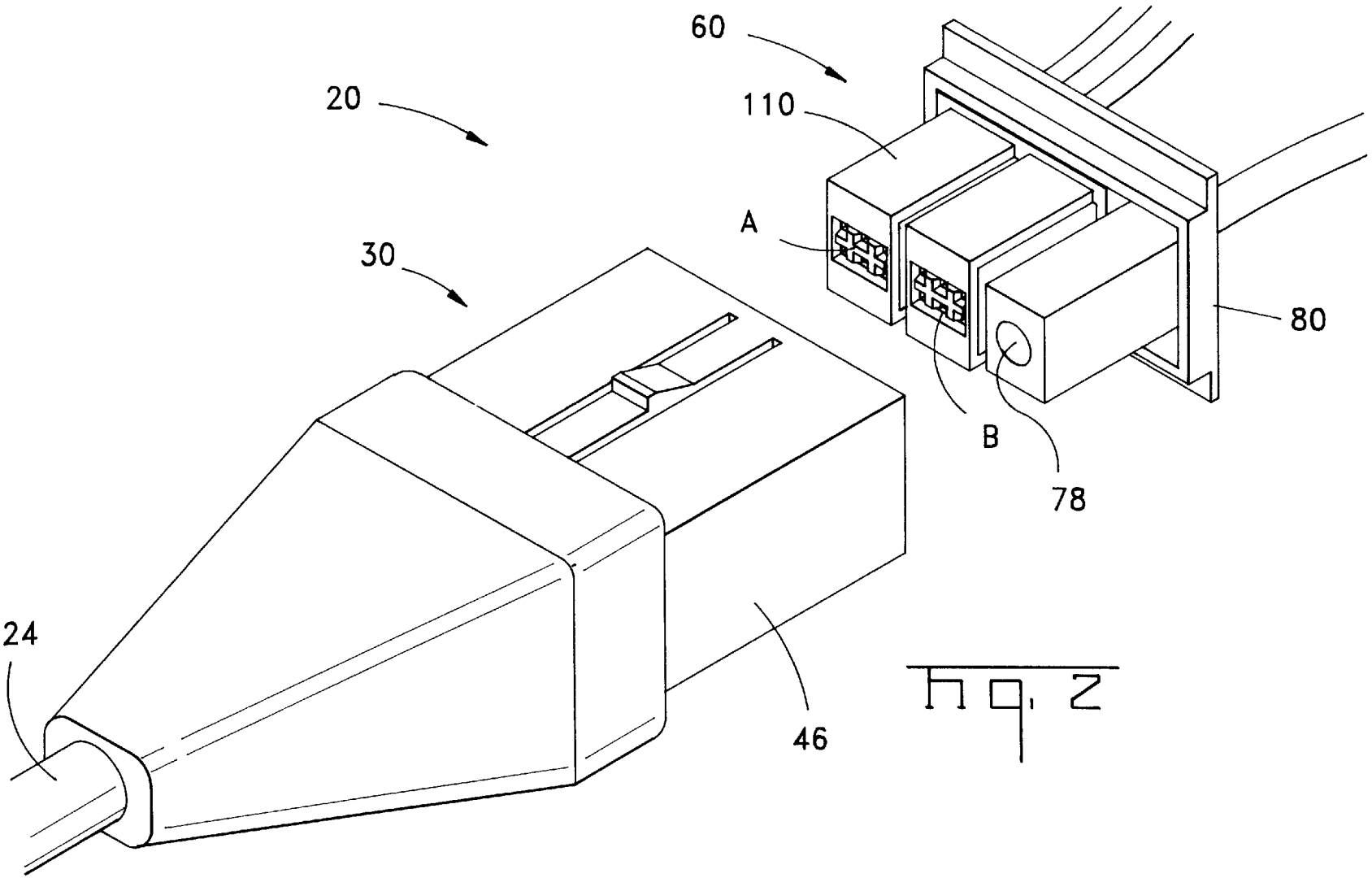
FIG. 2 is a view of the connector assembly shown in FIG. 1 showing the receptacle mounted on a panel in a vehicle with the secondary lock in place and showing a cord attached to the plug connector with an overmolded section securing the cord to the plug connector.
Figure 3:
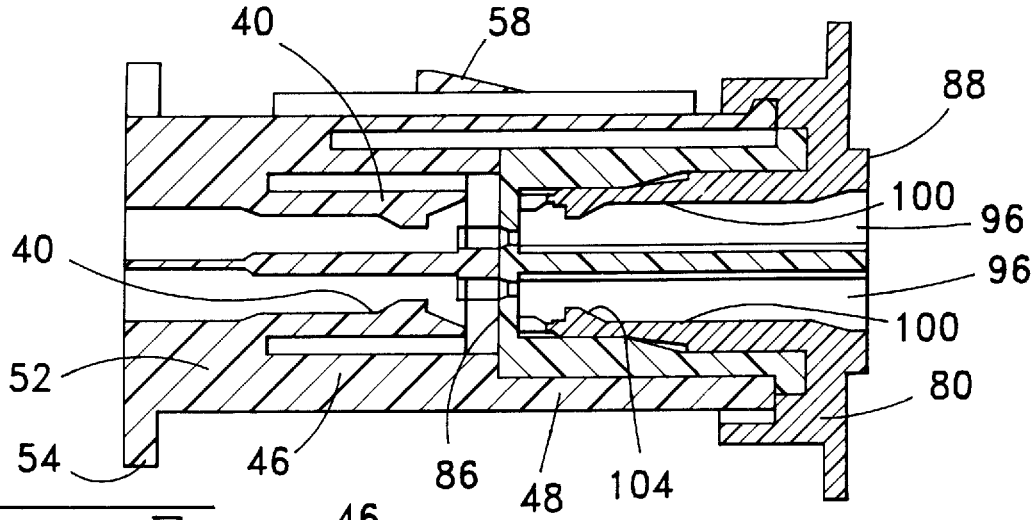
FIG. 3 is a side sectional view showing the two mated connector housing configurations. For the sake of clarity, the terminals are not shown positioned in the cavities of the two connectors.
Figure 4:
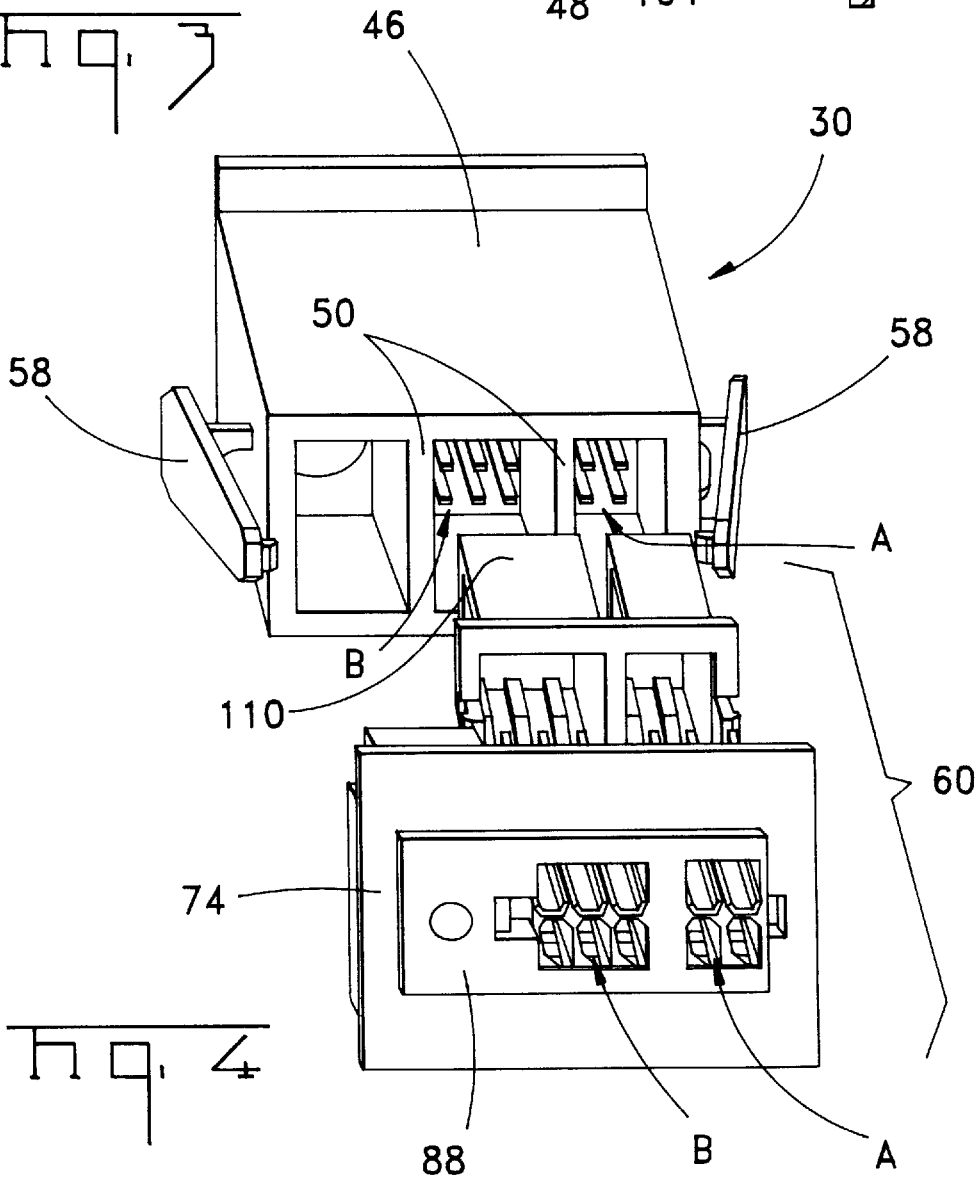
FIG. 4 is an exploded view of two connector housings and a secondary lock. This connector assembly embodiment differs slightly from the embodiment of FIGS. 1–3. The embodiment of FIG. 4 has ten terminal positions as opposed to the twelve positions shown in the embodiment of FIGS. 1–3, and this embodiment also includes two side mounted latches. The detail views of FIGS. 5–9 correspond to the embodiment of FIG. 4.
Figure 5:
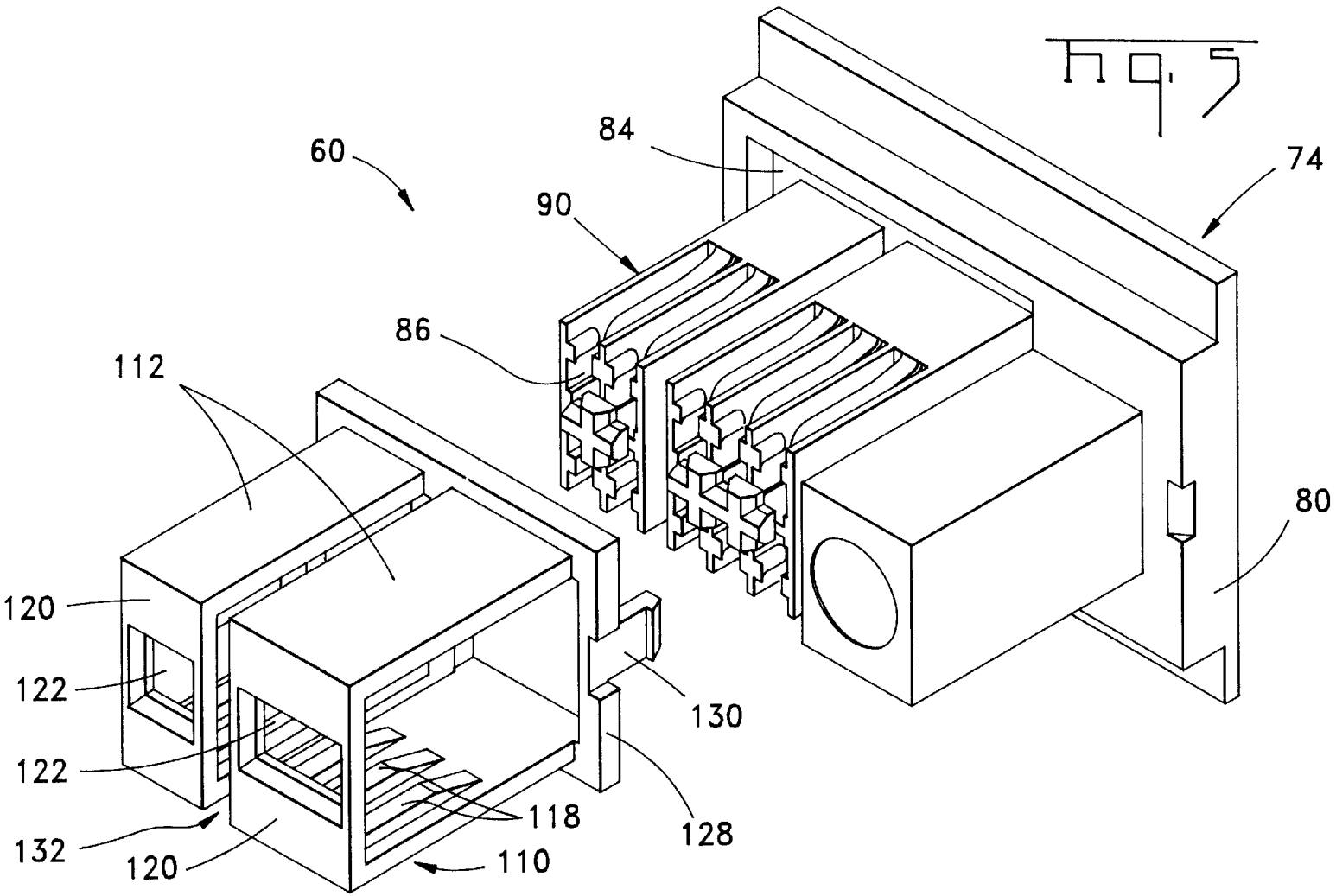
FIG. 5 is an exploded view showing more details of the vehicle mounted electrical connector housing and a secondary lock.

The first or plug electrical connector 30 includes male terminals or pins 32 mounted in a molded plug housing 46. In the preferred embodiments, pins 32 are located in two rows and are separated into two groups A and B which are separated by one internal wall 50. In the embodiment of FIGS. 1–3, six male terminals 32 are located in each group A and B. In this preferred embodiment, adjacent pins 32 in the same row and in the same group are positioned on 2.54 mm. centerlines. Adjacent terminals 32 in the two rows are also located on 2.54 mm. centerlines.

Each male terminal 32 has a mating pin section 34 located on the front of the terminal. This pin section 34 extends beyond the plug housing base 52 into open cavities surrounded by a plug housing shroud 48 and by internal walls 50 forming these cavities and separating the terminals 32 into separate groups A and B. Each terminal 32 also includes a standard crimp section 36 and a latch hole 38 located in a middle section of the terminal. Molded cantilever latch beams 40 snap into the latch hole 38 to secure the terminals 32 in the plug housing 46.

Plug connector 30 also includes a male coaxial terminal 42 located in a portion of the plug housing 46. The coax pin 42 is mounted in an opening 44 in a conventional manner.

Plug connector 30 also includes a lip 54 that extends from the top and bottom of the plug base 52. Lip 54 forms a means for securing an overmolded section 56 that secures the plug connector 30 to a cord 24 leading to the portable electronic device 22. A connector latch 58 is located on one side of the plug connector housing 46 which engages a surface on the second connector 60 to hold the two mating connectors together. A plug connector of this type could also employ two mating caps that can be snapped together or secured with fasteners around the cable and the rear end of the plug connector housing to provide a strain relief between the cable and the plug connector.

The second connector 60 is mounted on a vehicle and provides a connection to the vehicle electrical system. This second connector 60 can also be referred to as a receptacle connector or a vehicle side connector. Receptacle connector 60 is mounted on a wall or panel in the vehicle in a position where it will be easily accessible by an occupant of the vehicle or a user of the electronic device to which the plug connector 30 is attached. The vehicle side connector can protrude from the wall or panel or it can be positioned within a surrounding shroud or depression that provides sufficient clearance for the mating plug connector 30.

Receptacle connector 60 includes a plurality of female or receptacle terminals mounted in a molded housing 74. Each of the female terminals has a terminal front end 64 at the end of a receptacle box or mating contact section 66. In the preferred embodiment this receptacle box 66 is a stamped and formed section having a width that does not exceed approximately 2.1 mm. and a height that does not exceed 2.5 mm. A resilient spring contact in the receptacle box 66 engages the mating section 34 of a mating pin terminal 32 in a conventional manner. The receptacle box 66 also includes an opening 68 into which a molded primary lock or latch extension 100 extends to latch the receptacle terminal 62 in a terminal cavity 96 in the receptacle housing 74. Terminals 62 also include a conventional crimp section 70, and after the terminals have been crimped to a wire 18 in an automotive wiring harness 10, each terminal 62 is inserted into the corresponding terminal cavity 96 through the rear of the connector housing 74.

As in the plug connector 30, the receptacle terminals 62 are positioned in two terminal rows in multiple groups A and B of multiple terminals. The centerlines of the two terminal rows are spaced apart by a distance of 2.54 mm. The centerlines of adjacent individual terminals 62 in the same terminal group A or B are also spaced apart by a distance of 2.54 mm. The two terminal groups A and B are separated by a housing slots 94 that have a width sufficient to receive the internal walls 50 with plug connector shroud 48 when the plug connector 30 is mated to the receptacle connector 60. Both the male terminals 32 and the female terminals 62 are stamped and formed from a conventional spring metal. The pins could be brass,and the receptacles could be phosphor bronze or a copper, nickel, silicon alloy. The preferred material thickness would be 0.25 mm.

Receptacle connector 60 also includes a female coaxial terminal 72 of conventional configuration for mating with the male coaxial terminal 42 in plug connector 30. Female coax terminal 72 is positioned within a coax housing body 76 on one side of the receptacle connector housing 74. An opening 78 is large enough to receive the male coax terminals 42 when the first and second connectors are mated.

Receptacle connector housing 74 is molded from a conventional engineering thermoplastic such as nylon or PBT. Housing 74 extends between a front or mating surface or face 86 and a rear or terminal insertion face or surface 88. A housing base 80 is located at the rear face 88 and includes a channel 84 on the front surface of housing base 80. This channel 84 extends around the two sections 82 of the housing 74 that contain the terminal cavities 96 for the two terminal groups A and B. The coaxial terminal housing body 76 is located to one side of the base channel 84.

The terminal cavities 96 extend from the rear housing face 88 to the front face 86. Each housing section 82 includes multiple terminal cavities 96 arranged in two rows. Terminals 62 from one of the two terminal groups A and B can then be positioned in each housing section 82. The two housing sections 82 are separated by a housing slot 94 that extends perpendicular to the terminal rows. Each housing section can therefore be inserted into one of the pockets formed by the plug housing shroud 48 and walls 50 when the two connectors are mated.

Each of the housing sections 82 has an exposed top surface 90 and an exposed bottom surface 92 so that the cantilever latch beams 100, which comprise the primary terminal locks are exposed on the top and bottom of the housing 74. Each primary housing terminal latch 100 comprises a molded extension of the one piece connector housing 74. Each latch beam 100 has a free end 102 adjacent to the housing front surface 86 and is joined to the housing closer to the rear. Each latch beam 100 therefore extends forward on the exterior of the housing 74 and the housing section 82. A latch projection 104 extends inwardly adjacent the free end 102 and is dimensioned to fit within the opening 68 in the terminal 62. When a terminal 62 is inserted into a terminal cavity 96 through the rear face 88, the corresponding latch 100 first flexes outwardly as the latch projection 104 passes over the terminal front end 64. The latch free end 102 is pushed outwardly from its normal position on either the exposed top surface 90 or the exposed bottom surface 92. When the terminal 62 is fully inserted, the latch projection 104 fits in the terminal opening 68 to provide a primary lock for the terminal, and the latch 100 returns to its normal position in which latch free end 102 is no longer extended.

Figure 6:
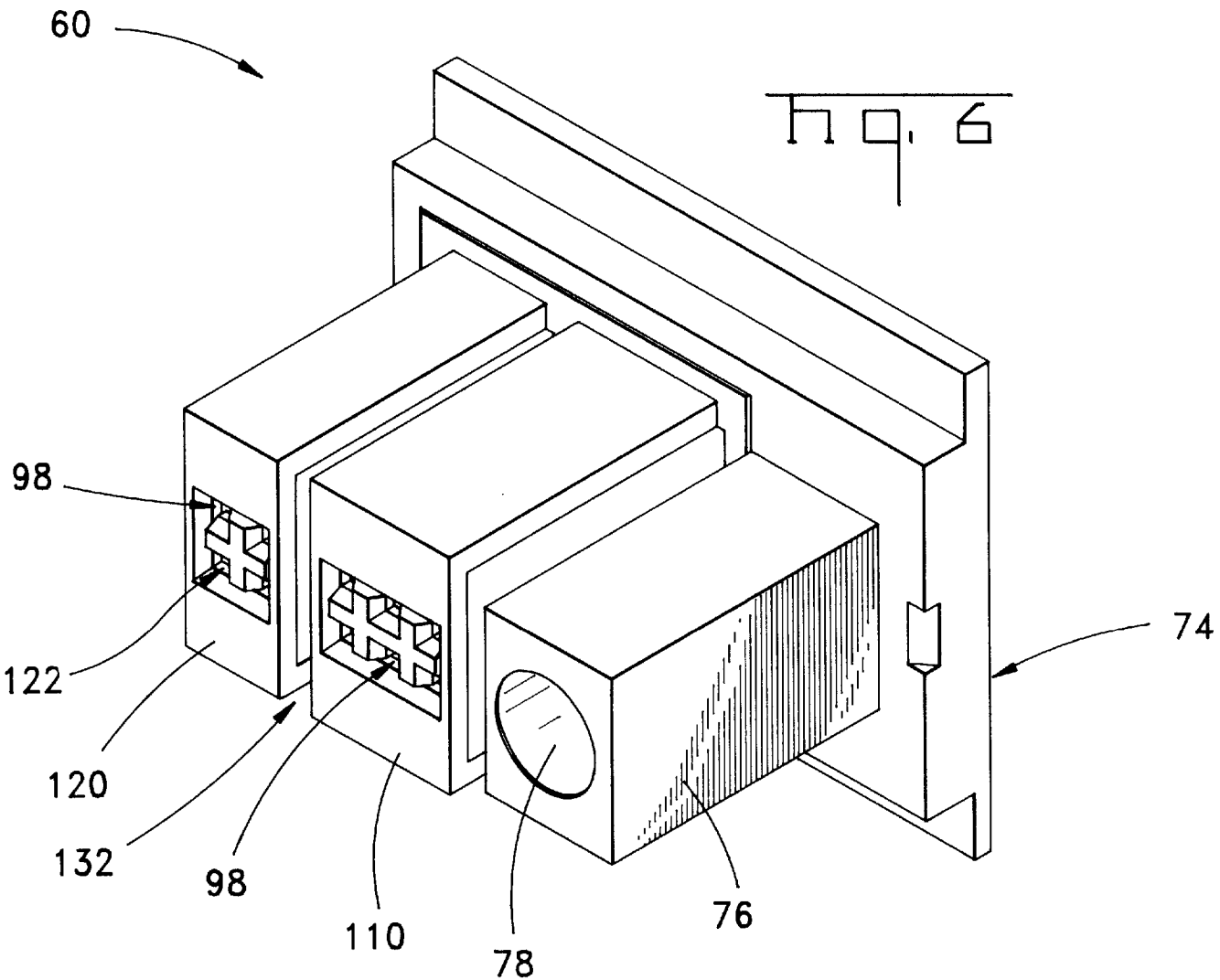
FIG. 6 is a view showing the secondary lock located in the fully inserted position forming a portion of the exterior of the vehicle mounted connector on the mating face.
Figure 7:
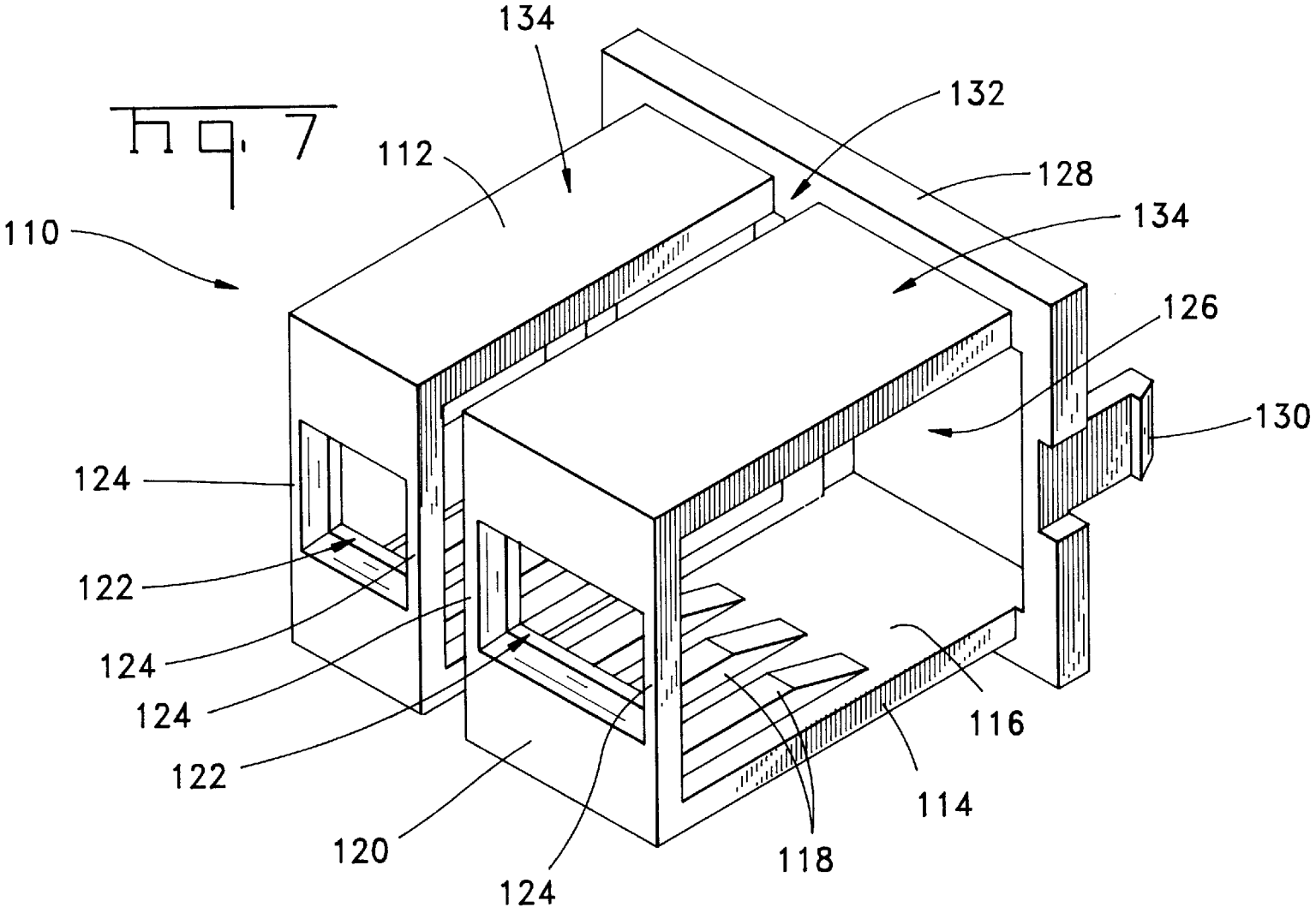
FIG. 7 is a three dimensional view of the secondary lock.
Figure 8:
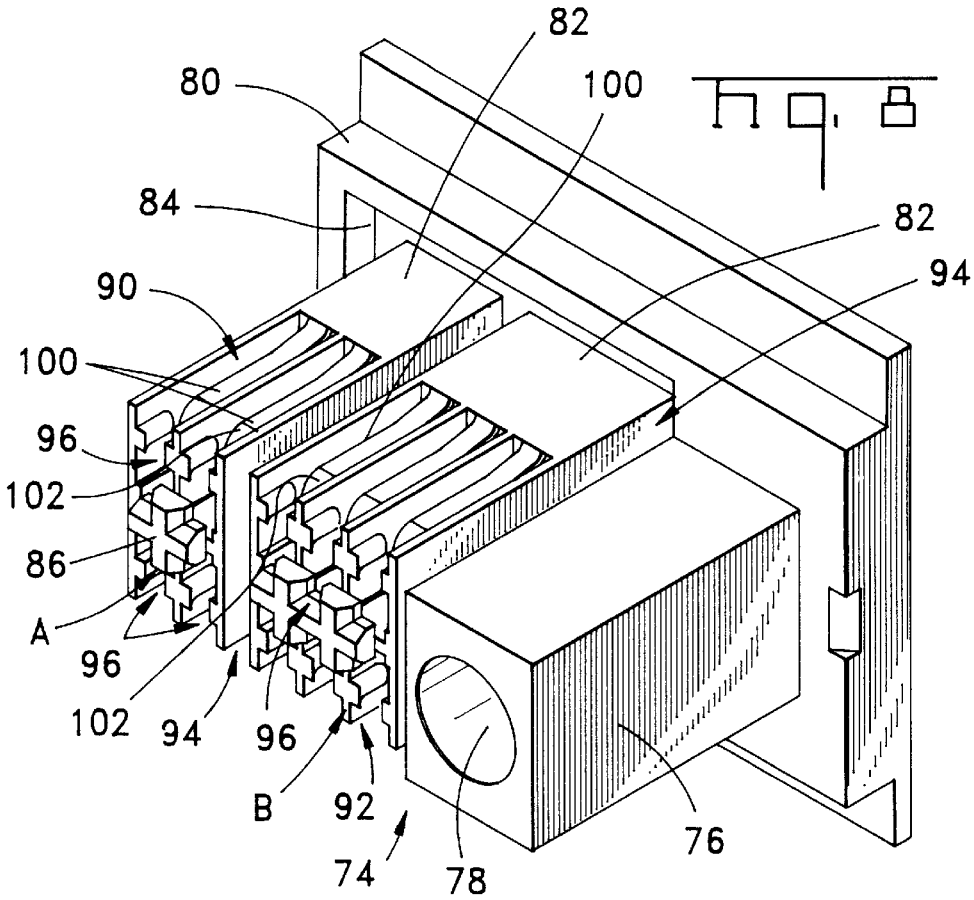
FIG. 8 is a three dimensional view of the connector housing showing the exposed molded terminal latches in each terminal cavity on the housing.
Figure 9:
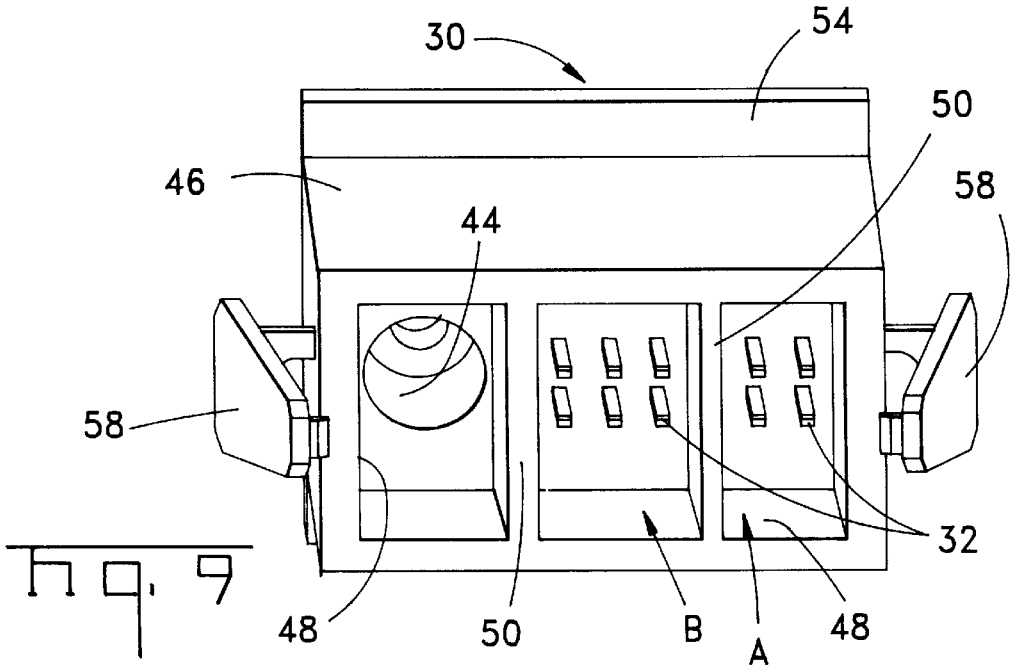
FIG. 9 is a view of the mating face of the plug connector.

Since both the top surface 90 and the bottom surface 92 are open or exposed, the terminal cavities 96 are also open on the mating face 86. In other words, the terminal cavity front openings 98 are not fully enclosed on the housing 74 as shown in FIG. 8, but are enclosed on four sides when the terminal position assurance member 110 is attached as shown in FIG. 6.

The receptacle connector 60 includes a secondary lock or terminal position assurance member 110 in addition to the housing 74 and terminals 62. This secondary lock 110 provides a secondary locking means for the terminals 62 because it provides a backup or reinforcement to the primary terminal latches 100 so that it provides an additional means for securing the female terminals 62 in the second electrical connector 60. Since the secondary lock 110 cannot be completely inserted onto the housing 74 unless all of the terminals 62 are fully inserted within corresponding terminals cavities 96, the auxiliary or secondary locking member 110 also comprises a terminal position assurance member. As will be more fully described subsequently, the terminal position assurance member 110 cannot be assembled to the front of the housing 74 unless all of the primary locking latches 100 are in their normal position with latching projections 104 positioned in corresponding terminal openings 68. If the terminals 62 are only partially inserted with the primary latches only partially engaged, the latch free ends 102 will protrude upwardly and will obstruct complete insertion or assembly of the locking member 110 on the front of the housing 74. Unless the terminal position assurance and secondary locking member 110 is fully assembled on the front of the second connector 60, the plug connector 30 cannot be properly mated to the receptacle connector 60.

The secondary locking member 110, which will also serve as a front exterior cover for the housing 74, includes top panels 112, bottom panels 114 and front panels 120. In the preferred embodiment, each of these three panels has a thickness of approximately 1 mm. The top panels 112 and the bottom panels 114 are parallel and extend forward from a rectangular open frame 128 at the base or rear of the locking member 110. The sides 126 of the secondary locking member are open. In the embodiments of FIGS. 1–10, the secondary lock 110 is divided into multiple sections 134 by a slot 132 that extends between adjacent top panels 112 and bottom panels 114 of lock sections. These slots 132 are located in the same relative position as the housing slots 94 and are wide enough to permit insertion of internal walls 50 on the plug connector 30.

Ribs 118 are located on the interior surfaces 116 of the top and bottom panels 112 and 114 respectively. These ribs 118 extend from the front panels rearwardly and include a tapered section at their rear. The ribs 118 are aligned with the terminal cavities 96 and the primary locking latches 100 in the connector housing 74. The thickness or height of these ribs 118 is 1.9 mm when measured form the exterior of the top or bottom panels from which they extend in the preferred embodiment. Since the thickness of the walls in this embodiment is 1 mm, the ribs extend 0.9 mm from the inner surfaces of the panels from which they extend in the preferred embodiment. It is these ribs 118 that engage the tops of the primary latches 100 and provided the reinforcement of the primary latches 100. The ribs 118 would also engage a protruding latch 100 and prevent complete insertion of the terminal position assurance member 110. It would also be possible that the ribs 118 could engage a protruding latch 100 and force a partially inserted terminal 62 out the rear of the housing 60 where it would be noticeable.

The front panels 120 also include openings or windows 122 through which the front cavity openings 98 are accessible so that the terminal pins 32 can extend into the terminal cavities 96 into engagement with terminals 62 when the connectors are mated. Vertical strands 124 extend along the sides of the windows 122 to connect the top portions and bottom portions of the front panels 120. The front panels 120 thus join the front ends of the top panels 112 and the bottom panels 114 to prevent bowing or warping of the top and bottom panels when the secondary lock is inserted. A protruding primary latch 100 would therefore not be able to bow or deflect the top or bottom panel sufficiently to permit the terminal position assurance member 110 to be wedged into position even though a single or multiple primary latches 100 were not in their normal retracted positions. Since the secondary locking member 110 is located on the exterior of the connector 60, the top and bottom panels 112 and 114 are also reinforced by the plug shroud 48 when the two connectors are fully mated. The internal walls 50 join the top and bottom of the shroud 48 so that the shroud remains relatively stiff so that it will not bow.

Figure 10:
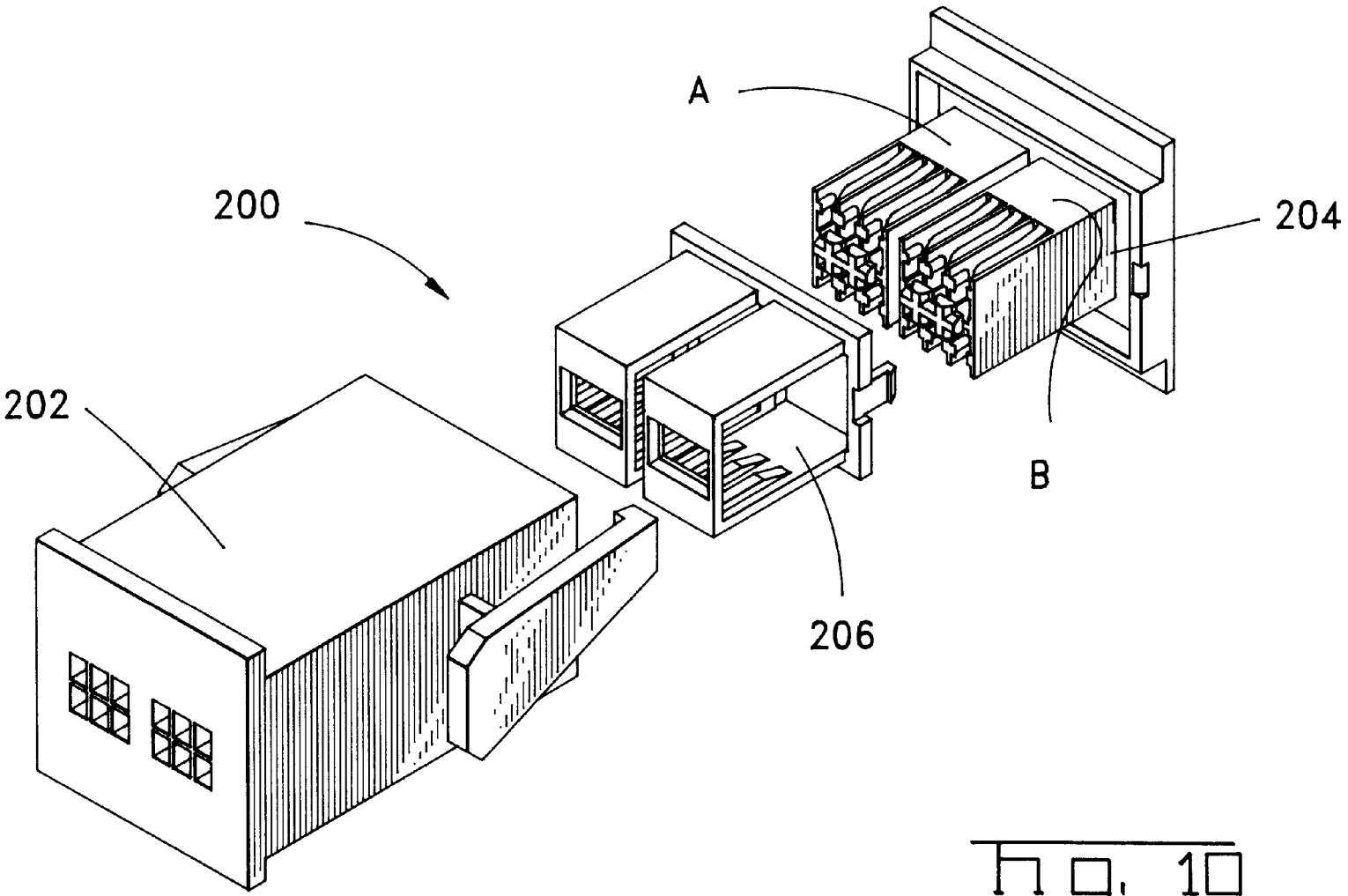
FIG. 10 is an alternate embodiment of this invention in which the terminals are positioned in two groups. This embodiment does not employ coaxial connectors.
Figure 11:
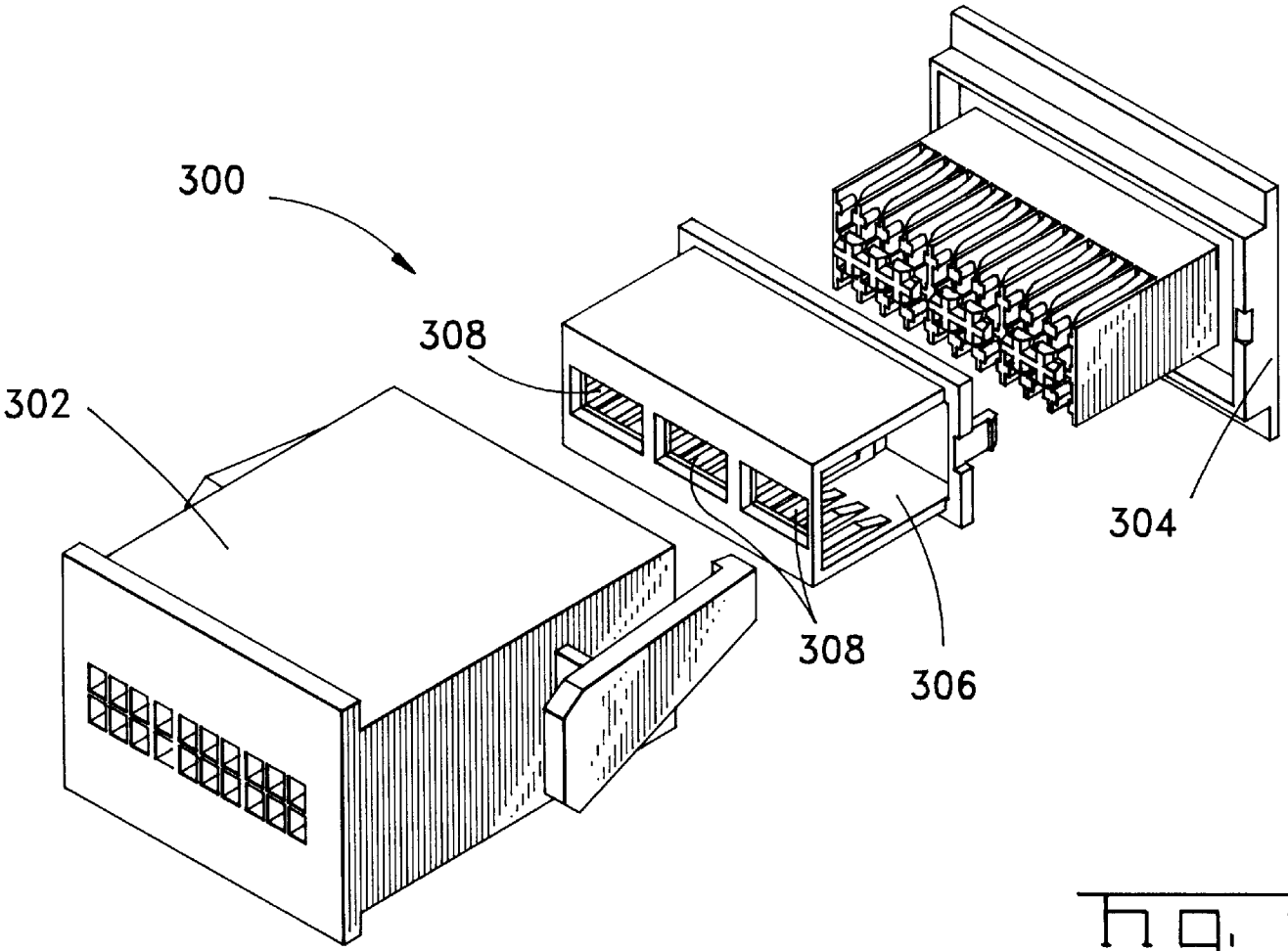
FIG. 11 is another alternate embodiment of this invention in which the terminals are not separated into separate groups.
Figure 12:
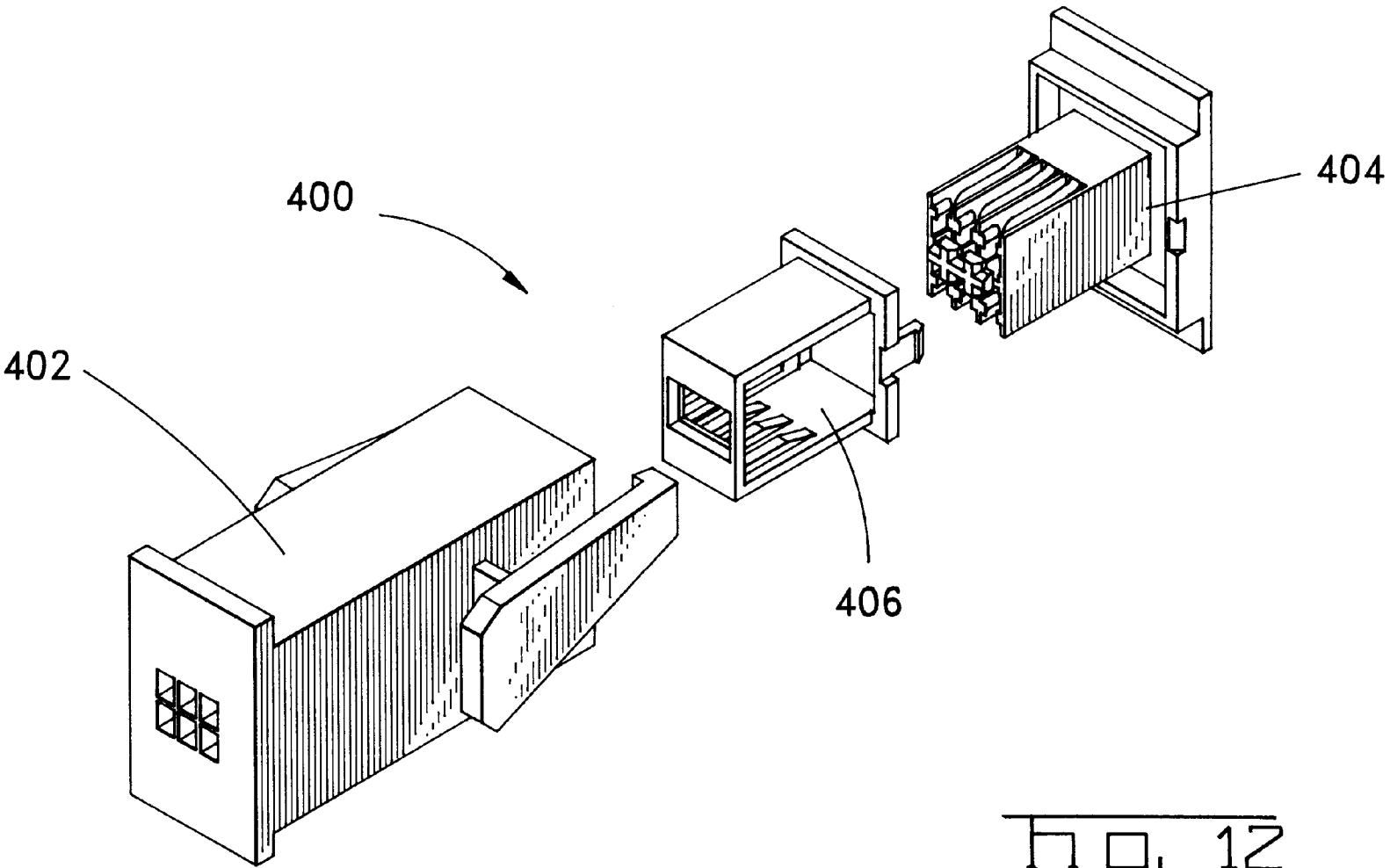
FIG. 12 is an alternate embodiment with six terminal positions located in two rows of three.
Figure 17:
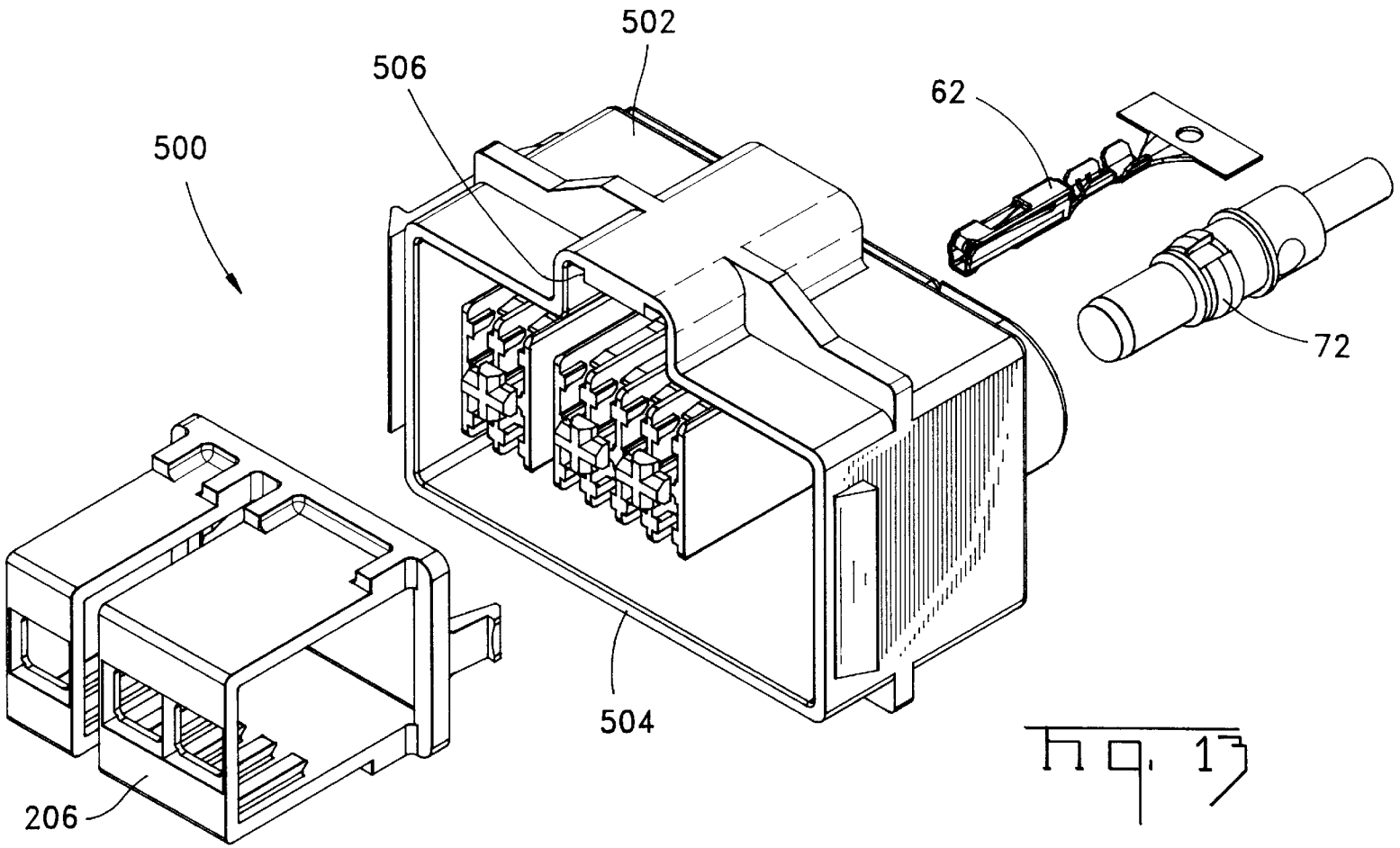

Although the two embodiments of FIGS. 1–9 are representative of the preferred configurations, other embodiments can also incorporate the elements of this invention. FIG. 10 shows a connector assembly 200 that is similar to the embodiments of FIGS. 1–9, but does not include the coax connection. Connector assembly 200 includes a plug connector 202 and a receptacle connector 204 together with a secondary locking member 206 that is identical to secondary locking member 110. FIG. 11 shows a twenty position electrical connector assembly 300 in which the terminals are not subdivided into groups in the plug connector 302 and the receptacle connector 304. The secondary locking member 306 includes top and bottom panels that are continuous between opposite ends. The front panel includes multiple windows 308 so that the front panel joins the front of the top and bottom panels at multiple intermediate locations to minimize any tendency of the top and bottom panels to bow when subjected to a load during mating. FIG. 12 is another embodiment of a six position electrical connector assembly 400. Plug housing 402 is mated to receptacle housing 404 and the secondary lock 406 is substantially the same as one of the lock sections 134 of the preferred embodiment.

FIG. 13 shows a receptacle connector housing 502 that includes a shroud 504 extending around the main housing body. This receptacle connector housing has two sections, one having eight terminal cavities, and the other having four terminal cavities, in which receptacle terminals 62 would be mounted. The carrier strip shown at the rear of the terminal would of course have been removed and the terminals 62 would be crimped to wires in a conventional manner. A coax terminal 72 would also be inserted into the housing beside the two receptacle housing sections. Terminal position assurance member 206, which is the same as that shown in FIG. 10. could be used with this connector housing, even though this connector includes a section for mounting a coaxial terminal. This receptacle connector could be mounted in a recess in a panel on an automobile. The shroud 504 would help to align a mating plug connector. A mating plug connector of the type shown in U.S. patent application Ser. No. 09/270,698, incorporated herein by reference, including a connector latch received within the shroud latching section 506 would be employed with this shrouded version of the connector 500.

Figure 14:
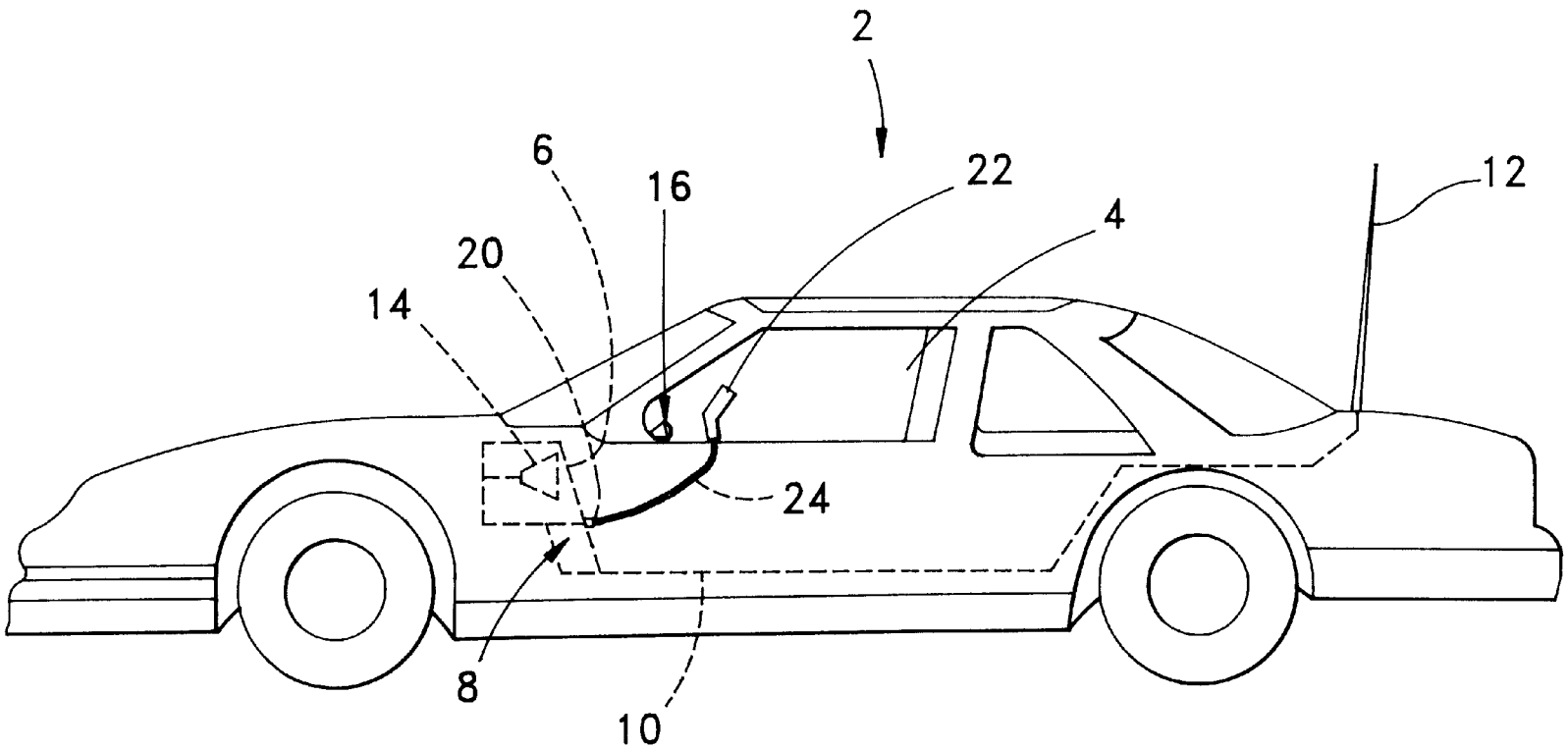
FIG. 14 is a view of an automobile schematically showing how this connector assembly can be used to connect an electronic apparatus, such as a cellular telephone, to components in an automotive electrical system.

The use of connector assembly 20 to connect an electronic apparatus, such as a cellular telephone 22, to the electrical system 8 of an automobile 2 is demonstrated in FIG. 14. The receptacle connector 60 is mounted on an exposed surface, panel or wall 6 in the passenger compartment 4 of the automobile where it will be easily accessible to an occupant of the automobile. The electrical system 8 includes an automotive wiring harness 10 to which the connector 60 of the connector assembly 20 is permanently attached. This electrical system can include an antenna 12, a speaker 14, a microphone 16 to which the wires 18 in the wiring harness 10 can be attached. In the embodiment depicted herein, the antenna is connected through a coaxial cable while the other components are connected by discrete wires or cables including discrete conductors. Other components, such as a power supply and system diagnostics modules, could also be attached to this wiring harness 10 and be part of the electrical system to which an external electronic device could have access. The electronic apparatus 22 is attached to the plug connector 30 by a cord 24. Although plug connector 30 would be a standard configuration for interfacing with the permanently mounted vehicle side connector 60, a connector on the opposite end of the cord 24 could have a configuration unique to the specific cellular telephone 22 or other apparatus that is to be attached to the electrical system. Multiple vehicle-side connectors 60, each with a different terminal configuration or a different size, for example configurations such as those shown in FIGS. 10–12, could be mounted at different locations so that different electronic devices could be attached to the system at the same time. For example, a global positioning satellite unit could be connected to one connector of this type. A portable computer could also be attached to a receptacle connector of this type to receive power from a power supply located in the motor vehicle and at the same time it could be connected to the external cellular telephone through the vehicle electrical system. Multiple separate plug connectors of the type shown in FIG. 12 could also be connected to the same vehicle-side connector so that different electronic components could be connected through the same vehicle-side interface connector. These are only examples of the types of devices that could employ connector assemblies of the type depicted by the representative embodiments; disclosed herein.

The multiple embodiments of this invention depicted herein are intended to show that this invention can be employed in a number of different configurations so that it can be used with multiple devices to be connected to the electrical system of the same motor vehicle. Therefore different configurations are important and the invention is not limited to the representative terminal layout configurations depicted herein. While this connector is specifically adapted for use in a motor vehicle, it is not necessarily so limited. Therefore this invention is defined not by the representative embodiments depicted herein, but by the following claims.

We claim:

1. An electrical connector for connecting an electronic device to a wiring harness in a motor vehicle, comprising:

a housing with receptacle terminals secured in the housing by terminal latches comprising extensions of the housing, the terminals being located in two parallel rows in at least one housing section, the terminal latches being exposed on top and bottom surfaces of each housing section;

a terminal position assurance member on the front of the housing and shiftable into a fully assembled position on the outside of the terminal latches only when receptacle terminals are fully inserted into the housing, the terminal position assurance member comprising support ribs extending from a top and a bottom panels forming top and bottom surfaces of each housing section and a front panel forming a portion of a mating face of the electrical connector.

2. The electrical connector of claim 1 wherein the top, bottom and front panels comprises thin flat plates with the ribs extending from an interior surface of flat top and bottom panels.

3. The electrical connector of claim 1 wherein the terminal position assurance member comprises a top panel and a bottom panel with a front panel joining the top panel and bottom panel, the top and bottom panels extending between front and rear ends of the housing sections.

4. The electrical connector of claim 3 wherein the front panel and the housing form openings for receipt of pin terminals in a mating connector.

5. The electrical connector of claim 3 wherein the terminal position assurance member comprises multiple top and bottom panels, adjacent top panels and adjacent bottom panels being separated by a slot.

6. The electrical connector of claim 5 wherein the terminal position assurance member includes multiple front panels, each front panel joining top and bottom panels separated by aligned slots.

7. The electrical connector of claim 5 wherein rear ends of the top and bottom panels are joined to a rectangular open frame including means for attaching the terminal position assurance member to the housing.

8. The electrical connector of claim 5 wherein ribs are located on the interior surfaces of the top panels and the bottom panels.

9. The electrical connector of claim 1 wherein the terminal position assurance member is open on the sides thereof.

10. The electrical connector of claim 1 wherein a shroud surrounds the housing.

11. The electrical connector of claim 1 wherein a shroud surrounds the terminal position assurance member.

12. An electrical connector assembly for use by an occupant to connect and disconnect an electronic apparatus to an electrical system in a motor vehicle, comprising:

a first electrical connector attached to the electronic apparatus, the first electrical connector including male terminals located in multiple groups of male terminals; and a second electrical connector, matable with the first electrical connector, mounted on the motor vehicle in a position accessible by an occupant of the motor vehicle, the second electrical connector including female terminals, the second electrical connector including primary locks securing the female terminals in the second electrical connector and a secondary lock providing an additional means for securing the female terminals in the second electrical connector, wherein the first electrical connector is attached to a cord extending between the first electrical connector and the electronic apparatus and wherein the female terminals are located in second groups corresponding to the groups of male terminals, the second groups of female terminals being separated by slots dimensioned to receive the internal walls separating groups of male terminals when the male and female terminals are mated.

13. An electrical connector assembly for connecting an electronic component to an apparatus including an electrical system comprising:

a first electrical connector attached to wires extending from the electronic component including a plurality of pin terminals, in at least one row, positioned in multiple groups of multiple pin terminals, adjacent groups of pin terminals being separated by an internal wall extending perpendicular to the row of pin terminals the internal wall separating groups of pin terminals having a shape different from a space between individual pin terminals in the group of pin terminals; and a second electrical connector attached to the apparatus comprising a plurality of receptacle terminals, also in at least one row, positioned in multiple groups of receptacle terminals, adjacent groups of receptacle terminals being separated by a slot extending perpendicular to the row of receptacle terminals, the slot separating groups of receptacle terminals having a shape different from a space between individual receptacle terminals in group of receptacle terminal, the slot being configured to receive the internal wall when the first and second electrical connectors are mated.

14. The electrical connector of claim 13 wherein the pin terminals and the receptacle terminals are each positioned in two parallel rows.

15. The electrical connector of claim 14 wherein groups of pin terminals and groups of receptacles do not include more than six terminals in the same group.

16. The electrical connector of claim 13 wherein the second connector includes a terminal position assurance member including a terminal position assurance slot aligned with the slot in the second connector.

* * * * *